United States Patent [19]

Erickson

[11] 3,952,871

[45] Apr. 27, 1976

[54] MACHINE LOADABLE MULTI-POCKET, MULTI-SECTION ARTICLE CARRIER STOCK

[75] Inventor: Arlen J. Erickson, Bainbridge Island, Wash.

[73] Assignee: CX Corporation, Seattle, Wash.

[22] Filed: Nov. 18, 1974

[21] Appl. No.: 524,398

[52] U.S. Cl. ..... 206/455; 200/425; 229/69; 229/72

[51] Int. Cl.[2] ..... B65D 85/30; B65D 27/10

[58] Field of Search ..... 229/69, 72; 150/39; 206/425, 455, 456, 39

[56] References Cited

UNITED STATES PATENTS

| | | | |
|---|---|---|---|
| 3,045,891 | 7/1962 | Alvarez | 229/69 |
| 3,299,928 | 1/1967 | Inkley | 229/72 |
| 3,360,027 | 12/1967 | Price | 150/39 |
| 3,588,456 | 6/1971 | McNabb | 229/72 |
| 3,845,800 | 11/1974 | Lookatch | 229/69 |
| 3,866,648 | 2/1975 | Anderson | 206/456 |

*Primary Examiner*—George E. Lowrance
*Assistant Examiner*—Bruce H. Bernstein
*Attorney, Agent, or Firm*—Christensen, O'Connor, Garrison & Havelka

[57] ABSTRACT

Successive carrier-length sections in which paper articles have been inserted, such as photoprints and negatives, are torn from the multi-leaf carrier stock along transverse score lines at successive interval locations along the stock. Initially bound together along only one longitudinal edge while incorporated in the body of the stock, two leaves of each carrier-length section become bonded together also at one end thereof when a carrier-length section is severed from the main stock by tearing it off along the transverse score lines, and in the act of tearing, withdrawing a portion of an intervening third lead from between the two other leaves so as to permit interengagement of contact adhesive patches pre-applied thereto.

14 Claims, 9 Drawing Figures

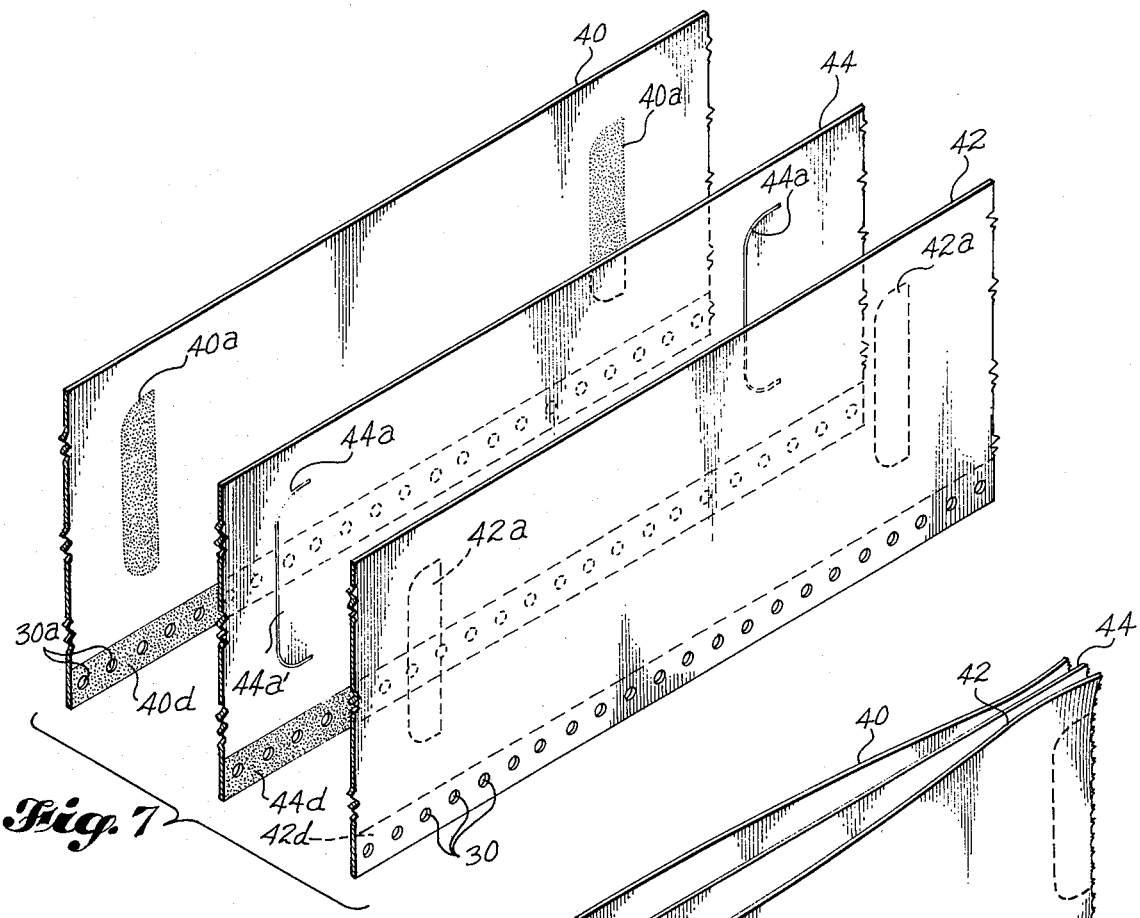
Fig. 7
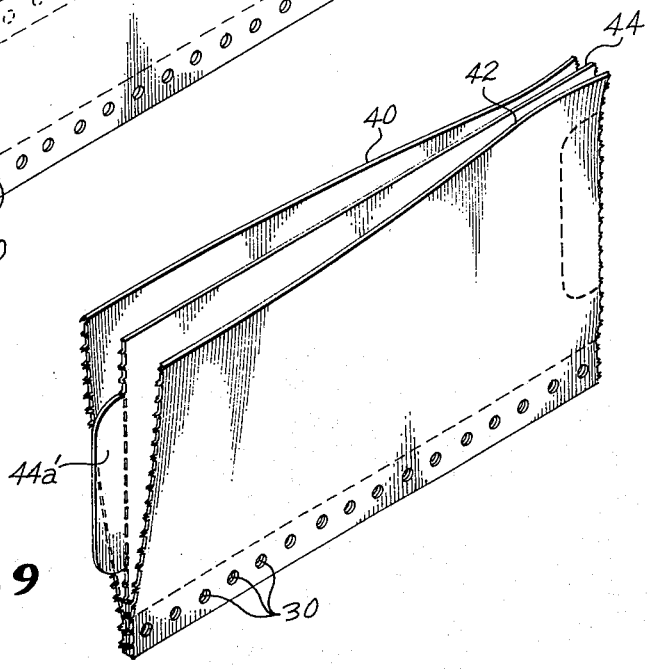
Fig. 9
Fig. 8
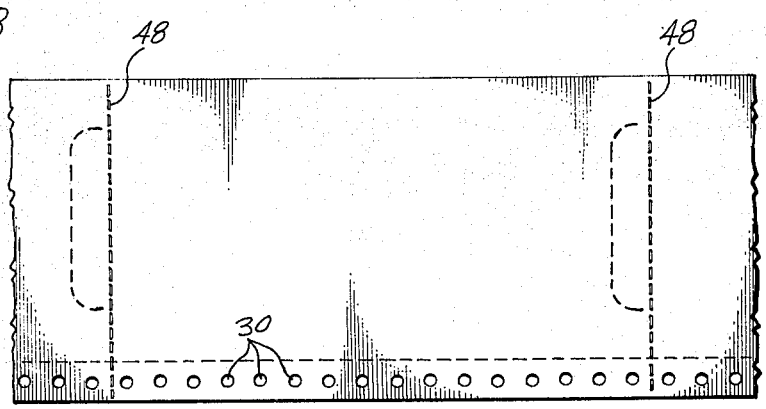

MACHINE LOADABLE MULTI-POCKET, MULTI-SECTION ARTICLE CARRIER STOCK

BACKGROUND OF THE INVENTION

This invention relates to multi-section carrier stock generally of the type usable in a commercial processor's method and apparatus such as that disclosed in U.S. Pat. No. 3,733,770 dated May 22, 1973. In that patent, multi-section carrier stock is fed progressively past a loading station whereat, with the leaves of the stock spread apart like opening of a book, photographic prints and negatives are mechanically inserted into the pockets or openings between the leaves in timed relation to the advancement of the stock, and thereafter the leaves are reclosed and the loaded individual carrier-length sections severed from the body of stock. In this way automatic mechanical loading is achieved at high rates of production and the components of individual customer orders are separately packaged for subsequent handling, such as inspection, pricing, repackaging, etc. However, there are times when a greater degree of security in the retention of the packaged articles is desired than that afforded by binding of the leaves together along only a single edge. For most purposes within the contemplated fields of usage of present concern, closing of the carrier at a second edge adjoining the first bound edge affords the desired added degree of security. An object hereof is to accomplish such results in a manner adding no separate or interruptive step in a mechanized packaging system, such as would be required if the added bonding were to be accomplished by stapling or by applying adhesive to the leaves and thereupon sticking them together.

More particularly, the present invention is directed to providing, in carrier stock of the kind indicated, or in equivalent applications as practical, inexpensive pre-applied contact adhesive patches and related locating of transverse scoring (or equivalent cutting or weakening lines in the leaf material establishing desired parting lines) at which the sections become severed from the main stock, such that bonding together of the leaves of each carrier-length section at one end of the section will be assured upon severance of a section from the main body of stock. However, the leaves are to be protected against becoming bonded together while still incorporated in the main body of the carrier stock so as not to restrict free spreading of the carrier leaves apart for insertion of articles between them when the stock is being advanced through a packaging station.

The invention is herein illustratively described by reference to its presently preferred embodiment; however, it will be recognized that certain modifications therein may be made without departing from the essential features involved.

SUMMARY OF THE INVENTION

Broadly, the invention comprises a sectionable, elongated multi-leaf strip assembly comprising a plurality of elongated, mutually superimposed leaves of paper-like material, such as an elongated carrier stock with leaves bound together along one longitudinal edge, having transverse score lines along which it may be severed into sectional lengths successively by tearing, and in the process of severance establish the condition by which leaves at one end of an emerging section may be bonded together merely by pressure of contact between them. To this end, two of the leaves having opposing pre-applied adhesive patches adjacent each set of score lines are normally (i.e., with the stock intact) separated by an interposed third leaf to prevent adhesive bonding and thereby to permit continuous feeding and spreading of the leaves as desired for insertion of articles between them at a loading station. Upon severance of one sectional length of the strip assembly, however, the intervening third leaf, which is scored to tear along a line at least part of which is offset from the score lines of the adhesive-bearing leaves, withdraws from between the adhesive patches of that section or the adjoining section and permits the affected leaves to come into contact with each other directly so as to effect the desired bond. Bonding contact pressure may be applied manually or by any suitable mechanical means such as a pressure roller located at or beyond the point of severance in any suitable arrangement.

In another embodiment of the invention, at least four elongated, mutually superimposed leaves are employed in the strip assembly and are conditioned for adhesive interbonding by mere contact at one end of each severed section of the stock by the process of severance. In this case, however, two or more sets of adhesive patches applied to the leaves in differently organized pairs, in each sectional length of stock each with a cooperating interposed "third" leaf, with relatively offset score line formations, assures that the adhesive patches are kept out of contact with each other with the strip assembly intact, but are permitted to make contact to form a bond between the members of each pair by withdrawal of a portion of the intervening third leaf from between the patches in the act of severance of one section from the next in the series.

These and other features, objects and advantages of the invention will become more fully evident from the description which follows by reference to the accompanying drawings.

BRIEF DESCRIPTION OF THE DRAWINGS

FIG. 7 is an isometric view of three strips prepared for collation to form article carrier stock of a further modified embodiment.

FIG. 8 is a side view of the collated and edge bound strips of the embodiment referenced in FIG. 7.

FIG. 9 is an isometric view of a detached section-length carrier of the last-mentioned embodiment.

DETAILED DESCRIPTION REFERENCED TO THE DRAWINGS

Figures 1, 2:
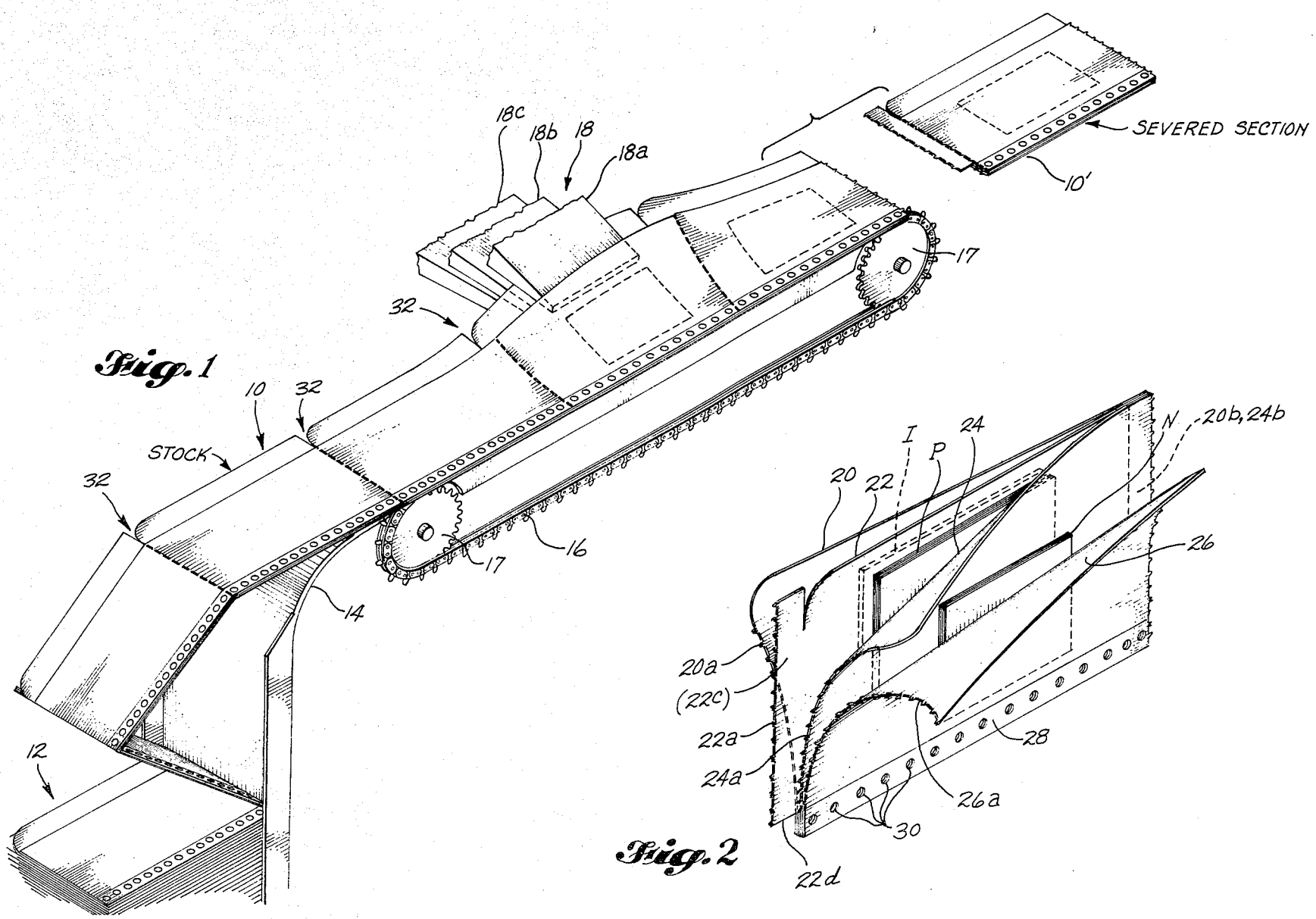
FIG. 1 is a simplified isometric view of a progressive feed mechanical loading or packaging device using multi-leaf carrier stock generally of the type disclosed in U.S. Pat. No. 3,733,770 and employing carrier stock in accordance with this invention.
FIG. 2 is an isometric view of a severed length section (i.e., individual packaging carrier) of the improved multi-leaf carrier stock carrying articles packaged therein and with a pair of the leaves bonded together at the leading end of a section by the act of severance of the section ahead of it.

As shown in FIG. 1, elongated, multi-leaf carrier stock 10 is conveniently retained by suitable means in an accordion-folded stack 12. Drawn from the stack over a guide device 14 by a toothed or sprocketed feed chain 16, the stock is fed progressively past an article loading station 18. In the illustration, the stock has four leaves, 20, 22, 24 and 26 interjoined at a common longitudinal edge 28, adjacent and along which edge the leaves have a continuous succession of evenly spaced apertures 30 designed to accommodate the teeth of the toothed chain 16 so as to provide positive engagement for stock advancement. Drive means for turning the chain drive sprockets 17 by progressive increments are not shown. The four leaves of the carrier stock, then, can be spread apart or opened like the pages of a book to define three packaging pockets or receiving compartments between the leaves. At the loading station 18, therefore, there may be provision for three separate loading chutes or input devices 18*a*, 18*b* and 18*c*, maintained in a position of insertion in the respective pockets or spaces between the leaves of the stock as it advances progressively past the loading station. In this process, the leaves progressively spread apart and then reclose as shown best in FIG. 1 and as described in the aforesaid U.S. Pat. No. 3,733,770. The stock's advancement may or may not be arrested each time a carrier-length section comes into receiving position relative to the loading devices 18*a*, 18*b* and 18*c*, depending upon the loading time requirement of particular loading means used.

The progressively fed stock 10 is provided with sets 32 of score lines (i.e., lines of weakening, however provided, to define the desired lines of severance by tearing or the like) at regular interval locations along the length of the stock, such score lines extending generally transversely of the stock. These define the ends of the desired carrier-length or package-length sections which can be severed from the body of stock by pulling or tearing the carrier-length sections therefrom successively, as depicted by one detached section at 10′ in FIG. 1. By appropriate timing of the progressive feed of the carrier stock at the loading station in relation to in-feed of articles to be packaged in the individual or successive carrier-length sections, each section torn from the carrier stock, then, will contain its own contents or items to be packaged therein, such as photographs, photographic prints and negatives. For example, the negatives are received in one compartment, good prints in a second compartment and bad prints or other materials in a third compartment (FIG. 2).

In accordance with this invention, leaves of the carrier-length sections successively emerging from the packaging process become bonded together not merely at the one longitudinal side edge 28, where the stock leaves are bound together continuously along the length of the stock, but also at a second, adjoining or transverse edge, in order to increase the security with which the contents of each detached carrier-length section are held. However, such bonding of the second or adjoining edge of the severed carrier-length stock is accomplished merely by contact pressure and without the necessity for use of staplers, adhesive activators, adhesive applicators or other separate means required to effect a bond after or in the process of severance of the carrier-length section. Moreover, the bonding technique employed is so conceived as to insure against accidental or premature bonding of the leaves together so as to interfere with the progressive opening and reclosing of the leaves freely as they move to and beyond the loading station for the reception of articles to be packaged therein.

To these ends leaf 20 has a transverse score line 20*a* preferably in registry with the respective corresponding transverse score lines 24*a* and 26*a* of leaves 24 and 26. The associated transverse score line 22*a* of leaf 22, which is interposed between leaves 20 and 24, is set back into one carrier-length section or offset from the others by a short distance representing a small fractional portion of the length of the carrier-length section, the one end of which is defined by the set of score lines just identified. Contact adhesive patches 20*b* and 24*b* are applied across the width of the respective leaves 20 and 24 in opposing relationship within the end area or zone defined in plan between the score line 20*a* and the associated score lines 22*a*, 24*a* and 26*a*, a tab or projecting end portion 22*c* of leaf 22 is pulled out from between the adhesive patches to come into direct contact with each other in order to establish a bond between leaves 20 and 24 across the end of the carrier-length section that had immediately adjoined the severed section 10′. A short longitudinal cut 22*b* at the base of the tab 22*c* and an associated offset of a short portion of the score line 22*a* where it coincides with the associated score lines 20*a*, 24*a* and 26*a*, respectively (FIG. 3) completes the definition of the line of severance for leaf 22.

Figure 3:
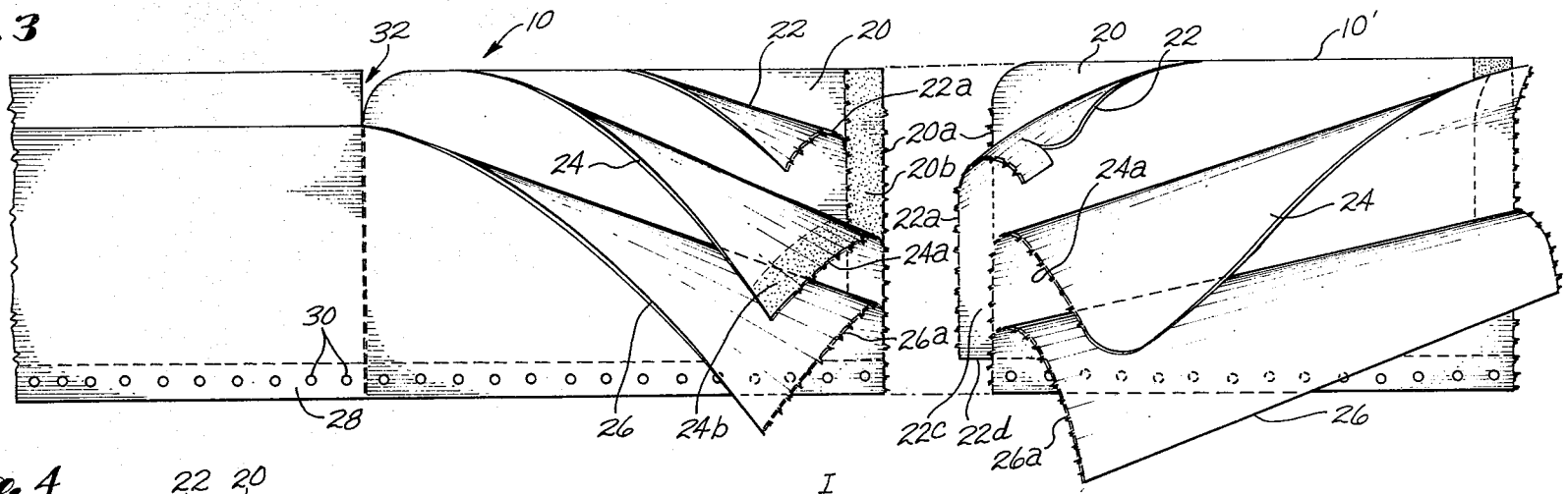
FIG. 3 is a face view of a portion of carrier stock with one carrier-length section severed therefrom thereby to permit contact pressure adhesive bonding at the leading edge of the next succeeding section, and with the leaves turned back to illustrate details.

It will be noted in FIG. 3 that the end of severed carrier-length section 10′ opposite the free tab 22*c* has already been closed in like manner by bonding its leaves 20 and 24 together at the end, this having been made possible by severance of the section (not shown) preceeding it in the series.

Figure 4:
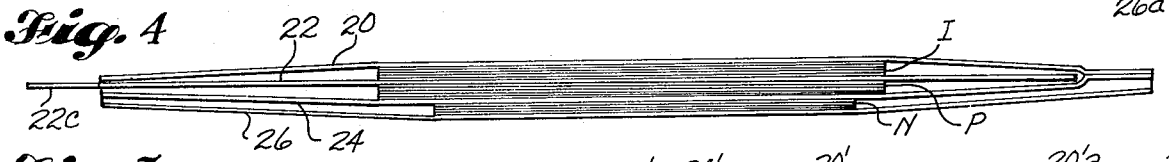
FIG. 4 is an edge view of a loaded section-length carrier.

In FIGS. 2 and 4, photographic negatives N are shown deposited in the pocket between leaves 24 and 26, photoprints P in the pocket between leaves 22 and 24, and other items I in the pocket between leaves 20 and 22. Because of the end bond as well as the longitudinal edge binding between leaves of the carrier-length section depicted, it will be evident that these packaged items, prints and negatives are held more securely at least in the last two-mentioned pockets than in the case of a carrier, the leaves of which are joined together only along the one edge at 28.

Figure 5:
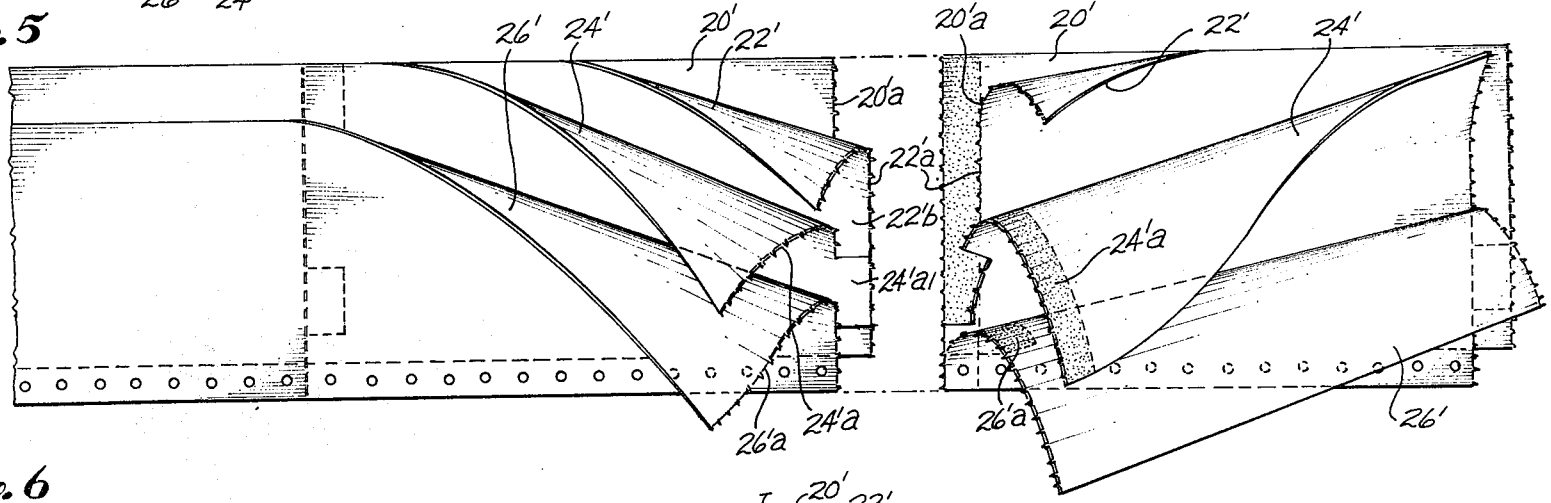
FIG. 5 is a side view similar to FIG. 3 showing a modified embodiment wherein two pairs of leaves of a multi-leaf strip assembly are interbonded adhesively upon severance of an adjoining length section of stock.
Figure 6:
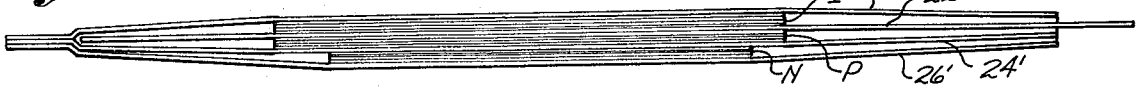
FIG. 6 is an edge view of the modified embodiment of FIG. 5.

In the embodiment shown in FIGS. 5 and 6, leaves and portions thereof including score lines corresponding to those in the previous embodiment are designated with the same numerals primed. Bonding together of the leaves 20′ and 24′ by the respective adhesive patches 20′*a* and 24′*a* occurs as in the previous case, but additionally bonding together of leaf 26′ with leaf 20′ also occurs in this modified embodiment by means of the adhesive patch 20′*a* on leaf 20′ and an adhesive patch 26′*a* on leaf 26′. In this instance, the leaf 24′ has its transverse score lines so configured in positional relationship to the associated score lines in the other leaves as to define a projecting tab portion 24′*a* overlapping and interposed between the adhesive patches 26′*a* and 20′*a* across a portion of the width of the strip, and withdrawn from between those patches, with the tab 22'*b*, upon severance of adjoining carrier-length sections. This then forms a window or notch in the marginal edge of the adjoining leaf portion 24' which permits adhesive patch 26'*a* to come into contact with the adhesive patch 20'*a* just as the adhesive patch 24'*a* can make contact with the patch 20'*a* after severance of the section in which the window is formed.

In the further modified embodiment shown in FIGS. 7 through 9, the leaves or strips of carrier stock to be formed are shown in FIG. 7 as prepared before collation and bonding of the three leaves together into carrier stock along one longitudinal edge of the leaves. In this instance, the two outer or cover leaves 40 and 42 have narrow patches or bands of adhesive 40*a* and 42*a* respectively applied at regular intervals in extending transversely across the inside faces of these cover strips, whereas the intermediate leaf 44 has U-shaped die cuts 44*a* to form flaps therein at the same interval locations or spacings along the length of that strip. The die cuts 44*a* preferably extend all the way through the strip material and with the legs of the "U" running lengthwise of the strip and being relatively short in relation to the intervening base of the "U" which runs transversely to the length of the strip. Bonding contact adhesive 40*d* and 42*d* applied to the inside face along one longitudinal edge of the cover strips 40 and 42 and similar bonding contact adhesive 44*d* applied to both faces of the intermediate strip 44 along one longitudinal edge thereof are also applied in this pre-collation conditioning of the strips.

Next, the strips are collated, that is, the three strips 40, 42 and 44 are placed in mutually superimposed registry with the feed sprocket holes 30 positioned in mutual registry so as to bond the strips together along one longitudinal edge by means of the contact adhesive layer 40*d*, 42*d* and 44*d*. In the process of collation, the strips are registered such that the adhesive patches 40*a* and 42*a* are in registry with each other and with the tab or flap cut free by the scoring 44*a*. Thereupon, the edge-bonded, collated strips are passed through a perforating device (not shown) which perforates all three strips along transverse score lines 48 running across the full width of the stock at the described interval locations, respectively adjacent to or intersecting the ends of the U-shaped cuts and the adjacent edges of the superimposed adhesive patches 40*a* and 42*a* as shown in FIG. 8. This is done automatically in a roll feed machine using conventional techniques needing no description herein.

Thereupon, when in use the successive carrier-length sections of the stock are torn off along the perforation lines 48, the cut flap 44*a* at the juncture where the section is removed is pulled out from between the adhesive patches of the adjoining section so as to allow those adhesive patches to come into contact with each other and thus to form a bond across the corresponding end of the carrier-length section (either the one removed or the one from which it is removed in the carrier stock) depending upon location on one side or the other of the line of perforation where tearing occurs. Although the transverse perforation score lines 48 also extends through the intervening strip 44, it does not fully sever but merely weakens the material. The flap cuts 44*a* made in the intervening strip 44 are continuous through-cuts, however, so that the flap or tab will remain with the adjoining body of the strip 44 when the carrier-length section is removed rather than to be lost to the adjoining strip as a result of tearing along the adjoining transverse score line 48.

The advantage of this last-described embodiment over those previously described is in the design whereby collation is simplified in that the main perforation tear lines 48 may be formed through perforating the stock layers simultaneously after collation and edge bonding. Thus, not only is precise registry of the tear lines in all three layers of the stock assured, but the stock is not weakened by such score lines preliminary to collation and thus susceptible of accidental tearing during handling in the collation process. The flap cuts 44*a* do not extend across the full width of the stock leaf 44 and, therefore, do not weaken the stock sufficiently to render it susceptible to tearing during collation. It is a comparatively easy matter to collate the stock layers with the adhesive patches 40*a* and 42*a* in registry with the flap cuts 44*a* and with the sprocket drive holes 30 in registry.

These and other modifications of the invention will be evident to those skilled in the art based upon an understanding of the foregoing disclosure of the presently preferred embodiments and as being included within the intended scope of the claims which follow.

I claim:

1. In mechanical packaging of sheet articles and the like, elongated multi-leaf packaging carrier stock having flexible leaves joined together along one longitudinal edge and free to be spread apart at their opposite edge for insertion of articles transversely between the leaves at an insertion station and thereafter reclosed in timed relation with longitudinal advancement of the stock, said stock comprising mutually superimposed first and second leaves and a third leaf interposed therebetween, the leaves having corresponding sets of transverse score lines at interval locations spaced lengthwise of the stock defining lines of severance of successive carrier length sections when torn from the stock at such locations, the first and second leaves at each such interval location having mutually opposed patches of contact adhesive applied thereto adjacent their respective score lines, the third leaf, separating such adhesive patches with the relatively adjoining carrier-length sections unsevered, having its transverse score lines offset from the correspondingly related score lines of the first and third leaves so as to withdraw a portion of the third leaf from between such contact adhesive patches when the relatively adjoining sections are severed and the leaves parted at the intervening associated score lines.

2. The carrier stock defined in claim 1, wherein the corresponding score lines in the first and second leaves are in substantially precise mutual registry extending in a straight line from edge to edge of the leaves, and the correspondingly related score lines in the third leaf extend substantially parallel to and offset from the last-mentioned score lines over at least a portion of the width of the stock.

3. The carrier stock defined in claim 2, wherein the mutually opposed adhesive patches comprise narrow bands extending transversely across the respective leaves and narrow in relation to the aforesaid spacing interval.

4. The carrier stock defined in claim 1, wherein the extent transversely of the strip of at least one of the mutually opposed adhesive patches comprises a minor fraction of the width of the strip.

5. The carrier stock defined in claim 1, wherein the extent transversely of the strip of that portion of the third leaf withdrawn from between the adhesive patches comprises a minor fraction of the width of the strip.

6. The carrier stock defined in claim 1 and a fourth leaf mutually superimposed on the second leaf and having transverse lines of severance at such interval locations, the fourth leaf and one of the first and third leaves having mutually opposed adhesive patches separated by one of the second and third leaves with the relatively adjoining carrier-length sections unsevered, and the last-mentioned one of said second and third leaves having at least a portion of its line of severance offset, longitudinally of the strip, in relation to such latter adhesive patches so as to withdraw a portion of the latter said separation leaf from between the adhesive patches in the act of severing such carrier-length section, whereby the first and second leaves become adhesively interbonded and the fourth leaf becomes adhesively bonded to one of the first and third leaves.

7. Multi-leaf elongated sectionable stock comprising mutually superimposed first and second leaves and a third leaf interposed therebetween, the leaves having corresponding sets of transverse score lines at interval locations spaced lengthwise of the stock defining lines of severance of successive carrier-length sections when torn from the stock at such locations, the first and second leaves at each such interval location having mutually opposed patches of contact adhesive applied thereto adjacent their respective score lines, the third leaf, separating such adhesive patches with the relatively adjoining carrier-length sections unsevered, having its transverse score lines offset from the correspondingly related score lines of the first and third leaves so as to withdraw a portion of the third leaf from between such contact adhesive patches when the relatively adjoining sections are severed and the leaves parted at the intervening associated score lines.

8. The stock defined in claim 7, wherein the corresponding score lines in the first and second leaves are in substantially precise mutual registry extending in a straight line from edge to edge of the leaves, and the correspondingly related score lines in the third leaf extend substantially parallel to and offset from the last-mentioned score lines over at least a portion of the width of the stock.

9. The stock defined in claim 8, wherein the mutually opposed adhesive patches comprise narrow bands extending transversely across the respective leaves and narrow in relation to the aforesaid spacing interval.

10. The stock defined in claim 7, wherein the extent transversely of the strip of at least one of the mutually opposed adhesive patches comprises a minor fraction of the width of the strip.

11. The stock defined in claim 7, and a fourth leaf mutually superimposed on the second leaf and having transverse lines of severance at such interval locations, the fourth leaf and one of the first and third leaves having mutually opposed adhesive patches separated by one of the second and third leaves with the relatively adjoining carrier-length sections unsevered, and the last-mentioned one of said second and third leaves having at least a portion of its line of severance offset, longitudinally of the strip, in relation to such latter adhesive patches so as to withdraw a portion of the latter said separation leaf from between the adhesive patches in the act of severing such carrier-length section, whereby the first and second leaves become adhesively interbonded and the fourth leaf becomes adhesively bonded to one of the first and third leaves.

12. A sectionable elongated multi-leaf strip assembly comprising at least four elongated mutually superimposed leaves of paper-like material joined together along a longitudinal edge and having transverse score lines at interval locations spaced lengthwise thereof defining lines of severance of successive sections torn therefrom, and means to effect adhesive bonding of the leaves of each section together adjacent such interval locations as the section is severed comprising mutually opposed contact adhesive patches on each of two of the leaves separated by a third leaf, the line of severance of the third leaf having at least a portion offset from the lines of severance of said two leaves to effect withdrawal of a portion of the third leaf from between said adhesive patches in the act of severing the section.

13. Multi-leaf elongated sectionable stock comprising mutually superimposed elongated first and second leaves and a third leaf interposed therebetween, the leaves being joined together along a longitudinal edge and having corresponding sets of transverse score lines at interval locations spaced lengthwise of the stock defining lines of severance of successive carrier-length sections when torn from the stock in such locations, the first and second leaves at each such interval location having mutually opposed patches of contact adhesive applied thereto adjacent their respective score lines, the third leaf, separating such adhesive patches with the relatively adjoining carrier-length sections unsevered, having in addition to its transverse score line at least one generally offset projection-forming cut at each interval location therein the ends of which terminate substantially at its transverse score line and forms a cut projection that lies in registry with the adhesive patches on the first and second leaves.

14. The stock defined in claim 13, wherein the cut is generally U-shaped and lying intermediate the longitudinal edges of the stock.

* * * * *